US009273855B2

(12) United States Patent
Doble

(10) Patent No.: US 9,273,855 B2
(45) Date of Patent: Mar. 1, 2016

(54) ILLUMINATED POLE

(75) Inventor: Simon Doble, Perigan Springs (AU)

(73) Assignee: Doble Telescopic Lighting Pty Ltd., Bristol (GB)

( * ) Notice: Subject to any disclaimer, the term of this patent is extended or adjusted under 35 U.S.C. 154(b) by 0 days.

(21) Appl. No.: 13/996,380

(22) PCT Filed: Dec. 20, 2011

(86) PCT No.: PCT/AU2011/001643

§ 371 (c)(1),
(2), (4) Date: Jun. 20, 2013

(87) PCT Pub. No.: WO2012/083354

PCT Pub. Date: Jun. 28, 2012

(65) Prior Publication Data

US 2013/0271966 A1 Oct. 17, 2013

(30) Foreign Application Priority Data

Dec. 20, 2010 (AU) ..... 2010905560
Jul. 27, 2011 (AU) ..... 2011902974

(51) Int. Cl.
*F21S 8/08* (2006.01)
*F21V 21/22* (2006.01)
(Continued)

(52) U.S. Cl.
CPC . *F21V 21/22* (2013.01); *A45B 3/04* (2013.01); *A63C 11/228* (2013.01); *E04H 15/10* (2013.01); *E04H 15/60* (2013.01); *F21S 9/02* (2013.01); *F21S 9/032* (2013.01); *F21S 9/043* (2013.01); *F21V 23/008* (2013.01); *F21V 23/023* (2013.01); *F21V 23/026* (2013.01); *F21V 23/04* (2013.01); *F21V 33/006* (2013.01); *A45B 2200/1018* (2013.01); *A63C 2203/14* (2013.01);
(Continued)

(58) Field of Classification Search
CPC ..... F21V 21/22; F21V 33/006
USPC ..... 362/418, 183, 190, 410, 433
See application file for complete search history.

(56) References Cited

U.S. PATENT DOCUMENTS 2,591,888 A * 4/1952 Steffen ..... 340/908
4,408,260 A 10/1983 Miedel
(Continued)

FOREIGN PATENT DOCUMENTS

CN 101806163 A 8/2010
WO 01/49957 A1 7/2001
WO 2009/005708 A1 1/2009

OTHER PUBLICATIONS

International Search Report for Appliication No. PCT/AU2011/001643 mailed Feb. 20, 2012 (2 Pages).
(Continued)

*Primary Examiner* — Vip Patel
(74) *Attorney, Agent, or Firm* — Nutter McClennen & Fish LLP; John J. Penny, Jr.; Joshua I. Rudawitz

(57) ABSTRACT

The present invention provides an illumination device comprising an elongated support element (10) with an illumination source (20) integrated therein. Preferably the elongated element is collapsible, telescopic or resiliently flexible. It may comprise a plurality of sections (11, 12) which are adapted to reciprocate between a retracted configuration and an extended configuration. The device is particularly suitable for temporary or collapsible structures such as tents, umbrellas, awnings, shades or the like.

19 Claims, 14 Drawing Sheets

(51) Int. Cl.

| | |
|---|---|
| ***A45B 3/04*** | (2006.01) |
| ***A63C 11/22*** | (2006.01) |
| ***E04H 15/10*** | (2006.01) |
| ***E04H 15/60*** | (2006.01) |
| ***F21S 9/02*** | (2006.01) |
| ***F21S 9/03*** | (2006.01) |
| ***F21S 9/04*** | (2006.01) |
| ***F21V 23/00*** | (2015.01) |
| ***F21V 23/02*** | (2006.01) |
| ***F21V 23/04*** | (2006.01) |
| ***F21V 33/00*** | (2006.01) |
| *F21L 4/04* | (2006.01) |
| *F21V 21/08* | (2006.01) |
| *F21W 111/00* | (2006.01) |
| *F21Y 101/02* | (2006.01) |
| *F21Y 103/00* | (2006.01) |

(52) U.S. Cl.

CPC .... *F21L 4/04* (2013.01); *F21S 8/08* (2013.01); *F21V 21/0824* (2013.01); *F21W 2111/00* (2013.01); *F21Y 2101/02* (2013.01); *F21Y 2103/003* (2013.01)

(56) References Cited

U.S. PATENT DOCUMENTS

| | | | | |
|---|---|---|---|---|
| 4,625,742 | A | 12/1986 | Phillips | |
| 5,351,704 | A | 10/1994 | Hunnicutt, Jr. et al. | |
| 5,463,535 | A | 10/1995 | Vest | |
| RE37,559 | E * | 2/2002 | Marue | B60P 3/18 248/188.5 |
| 6,463,947 | B1 | 10/2002 | Wipperfurth | |
| 2008/0173341 | A1 | 7/2008 | Falin | |
| 2009/0151763 | A1 | 6/2009 | Stehly et al. | |
| 2010/0147342 | A1 | 6/2010 | Navarro | |
| 2013/0335972 | A1 * | 12/2013 | Hubner et al. | 362/253 |
| 2014/0009915 | A1 * | 1/2014 | Nievas | A45B 3/04 362/102 |

OTHER PUBLICATIONS

International Preliminary Report on Patentability for Application No. PCT/AU2011/001643 mailed Apr. 22, 2013 (13 Pages).

* cited by examiner

ILLUMINATED POLE

Priority is claimed under 35 U.S.C. §119 to PCT/AU2011/001643 filed on Dec. 20, 2011, and Australian Patent Application No. 2010/905560 filed on Dec. 20, 2010 and 2011/902974 filed on Jul. 27, 2011, all of which are hereby incorporated by reference in their entireties.

TECHNICAL FIELD

The present invention relates to systems and devices for providing illumination and particularly but not only for providing illumination to temporary or collapsible structures such as tents, awnings, etc.

BACKGROUND ART

Any discussion of the prior art throughout the specification should in no way be considered as an admission that such prior art is widely known or forms part of common general knowledge in the field.

There are various forms of illumination for both interior and exterior use. Generally such forms of illumination are specifically designed for interior or exterior use and cannot be used in various locations. Further, generally illumination systems are specifically for a particular installation.

One of the difficulties associated with outdoors and outdoor activities, particularly in remote locations, is the need for illumination. While the thought "getting up" and "going down" with the sun is laudable, illumination is generally required during the evening for various reasons. In many cases people need to erect a shelter or tent, make food, etc in the evening and if one needs to leave the tent or simply carry out any activity which requires sight, some form of illumination is necessary. In many instances, the illumination is used as a location indicator so that occupants can make their way back to the camp site.

Generally this illumination is provided by a lamp or torch separate from the tent or support structure itself. In some cases the lamp is powered by fuel or gas which can negate the opportunity for using the illumination inside the structure. If batteries are used these are generally quite heavy. If light weight batteries/torches are used they generally provide insufficient illumination or their lifespan may be quite short. Additionally even with electric lamps, strip lights etc these generally require separate mounting and wiring as well as a power source. With the inconvenience and safety issues associated with conventional illumination systems, there has not been wide spread acceptance and use.

There is a need to provide an illumination source which is suitable for indoor and outdoor use, easily installed and preferably transportable, does not require complicated or expensive power source and wiring and still provide illumination for various activities both within and around the tent or similar temporary or collapsible structure.

It is an object of the present invention to overcome or ameliorate at least one of the disadvantages of the prior art, or to provide a useful alternative.

DISCLOSURE OF THE INVENTION

In the first aspect the present invention provides an illumination device comprising an elongated support element with an illumination source integrated therein.

In a preferred embodiment the elongated support element is a support pole for a collapsible or temporary structure such as a tent, umbrella, awning, shade or the like. The elongated support element can also be resiliently flexible such as required in domed tents. In another embodiment the support element is a strut or span of a collapsible structure such as provided in an expandable "scissor" frame of an awning or covering.

The term "integrated" refers to the light source being part of or held by the support element in a permanent or at least semi-permanent manner. It is not intended to include separate light sources connected to or installed inside a conventional support element such as a tent pole.

In a second aspect the present invention provides a support frame or support structure for a tent, umbrella, awning or the like comprising at least one elongated support element within the illumination source integrated therein.

The present invention provides an illumination source integrated into the elongated supported element. The elongated support element can be entirely or partly made from an extruded material of square, round, rectangular, triangular or oval cross section. The illumination source is preferably restricted to be within a predetermined relevant dimension of the elongated support element such that it remains within the perimeter of the support element. The relevant dimension may be the perimeter or circumference of the elongated support element. The relevant dimension may be the width of the support element. Such integration of the illumination source with the elongated support element preferably provides that it is permanently attached and does not in any way foul or interfere with the normal function of the elongated support element. The integration can be by any appropriate means but one particularly preferred technique is to provide a longitudinally extending channel or groove within which the illumination source can be retained.

The power source can be external to the illumination device or integrated therein. In one embodiment the power source may be releasably connected to the elongated support element to power the illumination source. In another embodiment, the power source can be integrated within the elongated support element, for example by batteries located within the elongated support element. This battery pack can be replaceable or in some instances rechargeable either after removal or in situ, by means of an external power socket. Such an external socket may also serve to directly power the illumination source.

In other embodiments, the illumination source may be solar powered or the batteries may be recharged by solar, or by mechanical recharging e.g. hand cranked or wind up generators.

The illumination source is preferably an LED strip. Preferably the LED strip is of low or medium intensity LED. This provides advantages in that it spreads the illumination to provide a more suitable illuminated area. High intensity LED's are generally not suitable for the present invention as they are designed to provide a narrow beam of directional light and use a lot of power.

Several strips of LED's may be integrated with the elongated support element. Preferably the LED strips do not extend substantially past the exterior surface of the elongated support element. In one embodiment the elongated support element may be collapsible/extendable. As will be discussed below, the LED strips can be integrated into the elongated support element such that there is no interference moving between the extended and collapsed configurations.

It will also be envisaged that the LED strip can include an integral lens system or a separate lens or cover may be placed exterior to the LED strip to focus or spread the illumination, and serve to protect the LED strip from damage.

In yet another embodiment, a heating strip may replace the illumination source. It will be understood by a person skilled in the art that the device can be provided with an energy source to provide either light, heat or both.

The control mechanisms for the energy source may be separate to the illumination device or integrated therein. In a particular embodiment, membrane touch controls can be integrated into the elongated support element for control of the energy source. Other techniques such as wireless remote control are also envisaged.

The illumination level provided by the LED strip is at least 0.25 LUX. The inventive device may be used alone or in combination with additional illuminations sources. In some instances the support elements of the tent or collapsible structure may be replaced entirely with the aforementioned support element with a user choosing to illuminate the interior or exterior of the structure by selectively powering a plurality of illumination sources. In certain embodiments a power supply is required for each illumination source. Alternatively several illumination sources may be powered by a single controllable power source.

There are a number of significant advantages arising from the present invention by integration of the illumination source i.e. LED strip with the elongated support element. The elongated support element can be telescopic and collapsible with no interference of the illumination source between extended and retracted configurations. This is quite different from the prior art. There are many prior art devices which incorporate LED's but they are generally in rigid beams or supports. Alternatively, in many cases light sources are attached or adhered to a support element by suitable means such as clips, adhesives etc. This requires complicated and time consuming installation, looks unsightly and in many cases fails to be used because of these issues or loss of various components. In particular, extensive wiring is generally used to position the lighting source on a support element.

The present invention removes all need for separate wiring or complicated installation techniques. The power source is provided direct to one end of the LED strip for example, with all wiring etc integrated into the LED strip. The telescopic, expandable, collapsible nature of the support element is in no way compromised by the integration of the illumination source and there is no need for complicated mounting equipment for providing an illumination or heat source into the support element, unlike conventional systems.

By appropriate configuration of the integration of the illumination source with the support element, the device can be used both internally and externally in a tent or similar structure. It can be configured to stand vertically, horizontally or over a curvature etc. In this regard the specification will refer to use of the elongated support element with reference to a tent or similar collapsible structure. However, it will be understood by persons skilled in the art that the device may be used as a separate stand alone illumination source or used in other configurations.

it will also be understood that the inventive device has application in other external and internal uses such as for example walking sticks and hiking/ski poles, portable emergency lighting equipment and internal domestic usage.

BRIEF DESCRIPTION OF THE DRAWINGS

Preferred embodiments of the present invention will now be described with reference to the accompanying drawings in which.

BEST METHOD FOR CARRYING OUT THE INVENTION

The present applicants have devised an elegant, robust and cost effective system for illuminating the interior or exterior of a tent, umbrella, awning or shade or similar collapsible structure. The device can be used in conjunction or independently from such structures as it comprises an elongated support element with an illumination source integrated therein. The integration of the illumination source allows the support element to be used in its normal function without interference from the illumination source. In some of the embodiments shown, the elongated support element is a tent pole used to support a tent or similar collapsible structure such as an awning etc. It will be understood by persons skilled in the art, however that the elongated support element maybe provided in other forms.

Figures 1A, 1B, 1C:
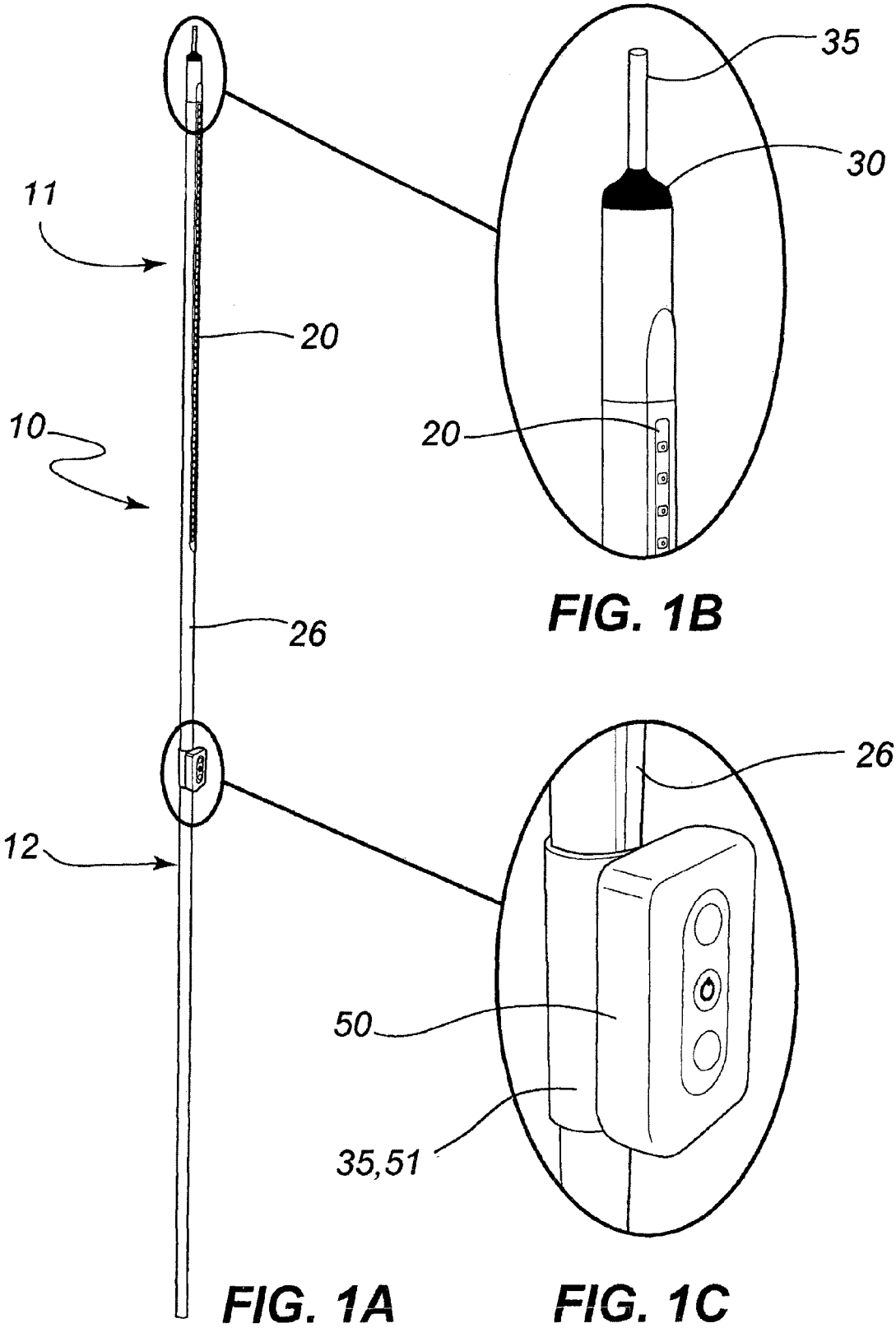
FIGS. 1A-1H show various details of a first embodiment of the present invention.
Figure 10:
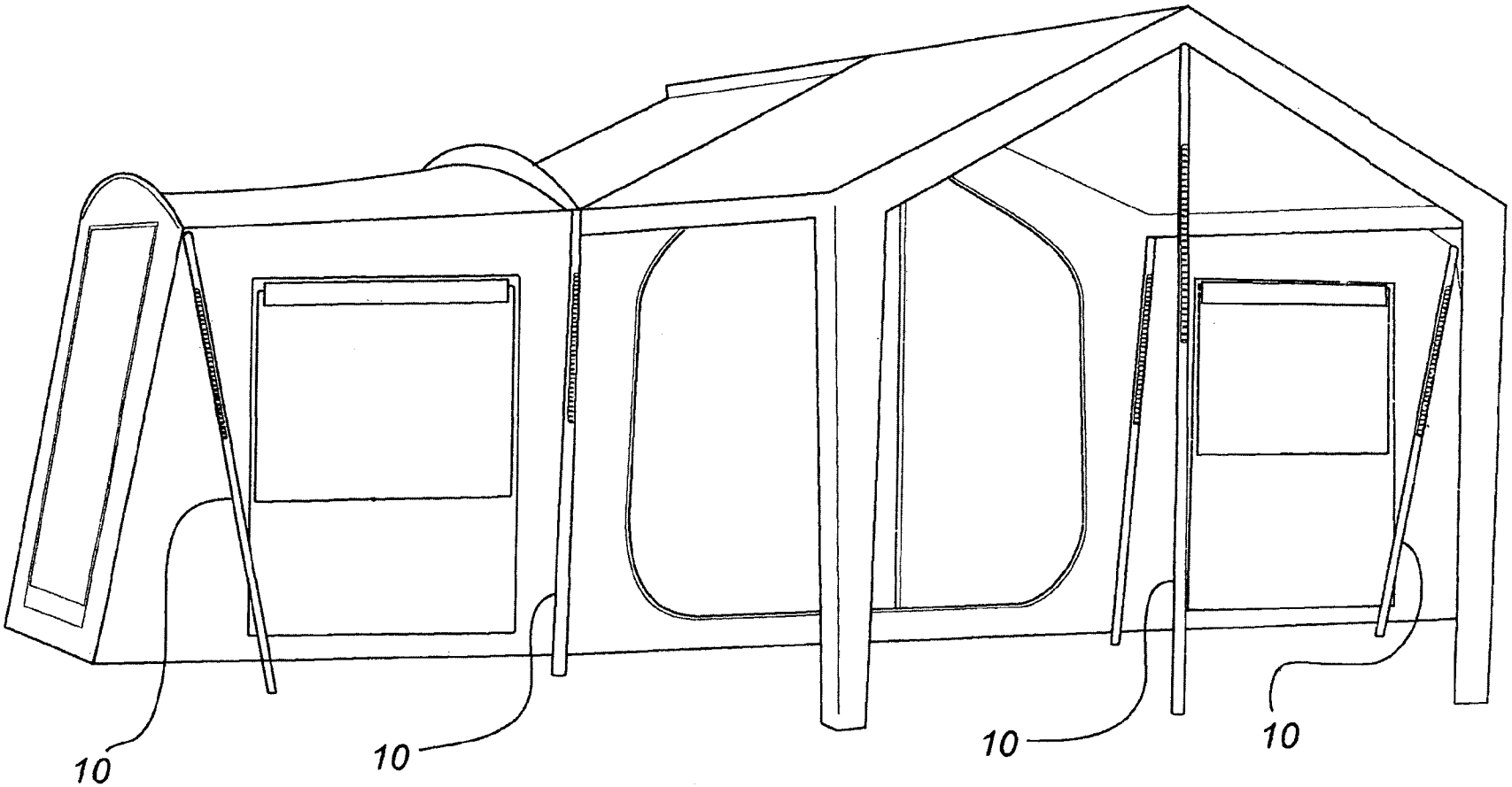

Refer firstly to the embodiments shown in FIGS. 1A-1H. FIG. 1A shows the inventive device it its extended "in-use" configuration. FIGS. 1B and 10 are detailed views of the upper most portion and power source respectively. FIGS. 1D-1H are detailed views of various components of the inventive device shown in FIG. 1A.

Figure 1D:
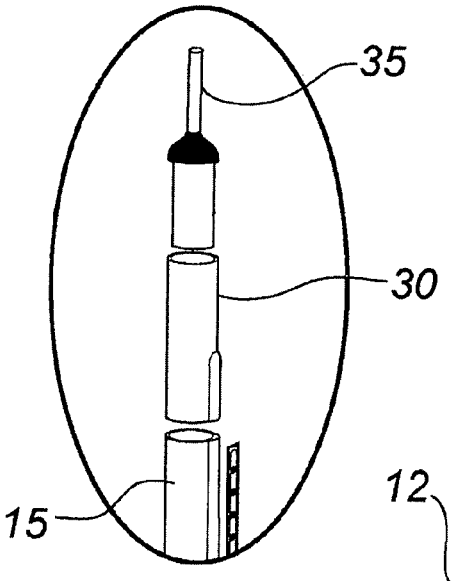
Figure 1E:
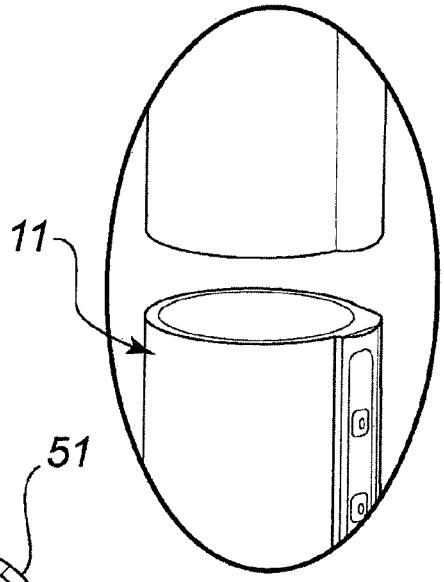
Figure 1F:
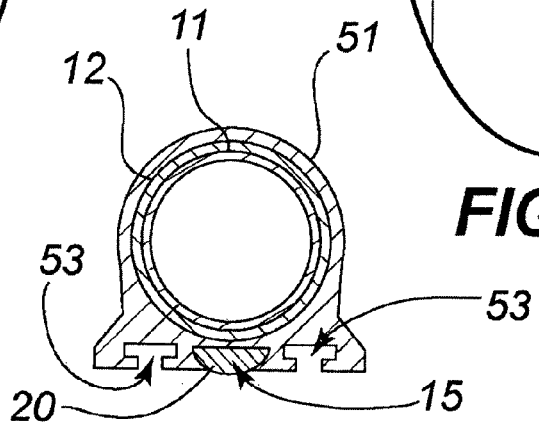
Figure 1G:
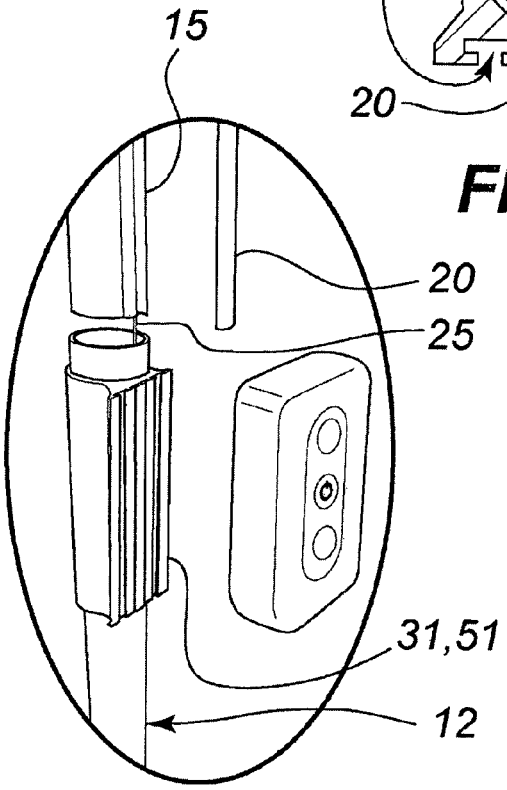
Figure 1H:
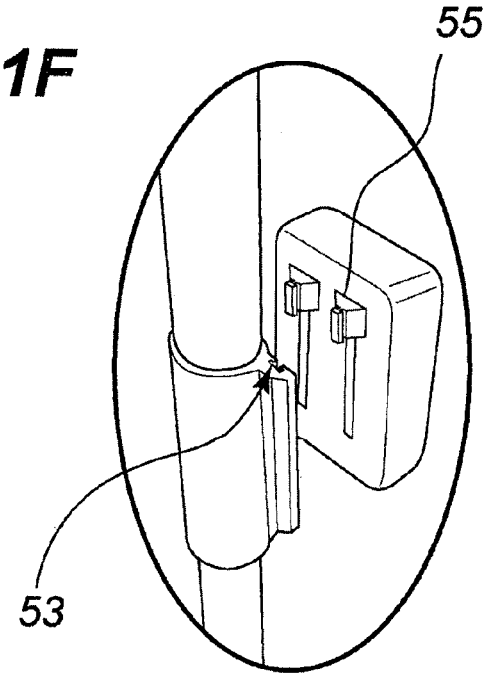

In the embodiment shown in FIGS. 1A-1H, the elongated support element 10 has a top portion 11 and a bottom portion 12 adapted to telescope together. Integrated in at least the top portion 11 is an illumination source in the form of an LED strip 20. As shown more clearly in FIGS. 10, 1G and 1H a power source/control unit 50 in the form of a battery pack can be connected to the elongated support element 10 by mount 51. The power source/control unit 50 not only provides power to the illumination source i.e. LED strip, it also controls the level of brightness and initiation i.e. on/off of the LED strip. With reference to FIGS. 1F and 1H the power control unit 50 is mounted by sliding over and engaging with slots 53 in the mount 51.

A shown in FIG. 1H the power control unit 50 has electrical contacts 55 protruding from the rear and adapted to connect with and provide electric power, via internal wiring 25, to the LED strip 20. In the embodiments shown, once the bottom and top portions 11 and 12 are extended and the support element 10 is in its normal vertical orientation, the LED strip 20 is provided at an elevated position on the pole 10. In some embodiments this position may be altered by relative movement between portions 11 and 12, and in other embodiments the LED strip 20 itself may be moveable along the length of the support element 10.

As shown more clearly in FIGS. 1E and 1F the illumination source or LED strip 20 is integrated into the support element 10. Since upper portion 11 may be telescope on bottom portion 12 the positioning and direction of the LED illumination source 20 can be altered as desired by relative movement and rotation of portions 11 and 12. Both the height and direction of the illumination source 20 is a simple matter of adjusting the relative position of upper portion 11 on lower portion 12. As shown in FIGS. 2A-2I a simple screw knob 70 or clamping mechanism may be used to alter relative heights or the top and bottom portions 11, 12 or direction of the illumination source 20.

In the embodiments shown, collars or mounting covers 30, 31 are provided at either end of the LED strip 20 as shown more clearly in FIGS. 1D, 1E and 1G. These covers assist in maintaining the integrated position of the illumination source 20 within the support element 10, preventingress of foreign matter and water and generally protect the ends of the illumination source 20. At least one of the collars 31 can simultaneously act as a mount 51 for the power source/control unit 50. The upper collar 30 shown in the embodiment of FIG. 1D further includes an aperture for receipt of a pin or spike 35 as per a conventional tent pole.

The integration of the illumination source/LED strip 20 into the upper portion 11 is shown more clearly in FIGS. 1D-1F. The upper portion 11 is an extrusion which comprises a channel section 15 (see FIG. 1F). This channel section 15 is adapted to receive and hold the illumination source 20. The integration of the illumination source in the elongated support element 10 has a number of significant advantages over the prior art. The device is simple and safe to erect and use with no exposed live wiring etc. Power is provided by simple attachment of the battery pack/power source 50 to the support element 10. It will be noted that there are no additional components apart from the power source. The device 10 essentially acts in a manner similar to a conventional tent pole. The illumination source provided by LED strip 20 does not extend past the perimeter of the tent pole and the tent pole can move between its extended and retracted configurations with no interference from the illumination source. The device may be used as a support element with simultaneous illumination if desired or used without illumination. The device can be used internally, externally or indeed independently of any tent or similar collapsible structure. The other advantages arising from the present invention such as stability in wind or confined spaces will be clear from the following description.

It is preferred that the LED strip 20 is a low or medium intensity strip. Tests were conducted using a standard brightness LED 3528 and super bright LED 5050. These are preferred LED strips since both have relatively low power consumption and are available in a water proof outdoor version. In one particular embodiment the LED strips are coated in a clear flexible silicon that gives a water proof rating of at least IP66.

The technical specifications of both LED strips are shown below in table one.

| | LED3528 | LED5050 |
|---|---|---|
| Number of LEDs/meter | 60 | 60 |
| Operating voltage | 12 v | 12 v |
| Power consumption (watt/meter) | 0.96 | 2.9 |
| Current/meter (mA) | 80 | 241 |
| Luminous intensity (Lumens/5 m) | 390 | 750 |
| Luminous intensity per LED (mcd) | 350 | 900 |
| Dimensions | 8 × 3 mm | 10 × 3 mm |

As will be clear to the persons skilled in the art, tent poles or support structures are generally placed several metres apart when erecting a tent, awning or similar temporary, collapsible structure. Tests have been conducted using the aforementioned concept with a simple structure using 4 illumination devices based 3 metres apart. 4 different scenarios were tested using the aforementioned LED 3528 and LED 5050 strips. In addition, the strip length was tested using a 1 metre length of LED and 50 cm lengths of LED.

The individual LED 3528 and LED 5050 strips emit approximately 200 Lm and 324 Lm respectively. 4 different scenarios were tested namely a) 2×1 metre LED 3528 strips in neighbouring corners;

b) 2×1 metre LED 5050 strips in neighbouring corners or; (all 4 strips illuminated but with half strip length back at 50 cm strip length.)

These tests confirmed that even when only one of the aforementioned illumination strips was activated, acceptable illumination was provided to a table in the centre of the 3×3 metre structure. Of course, the intensity of this illumination increased as more illumination was provided.

Figure 4:
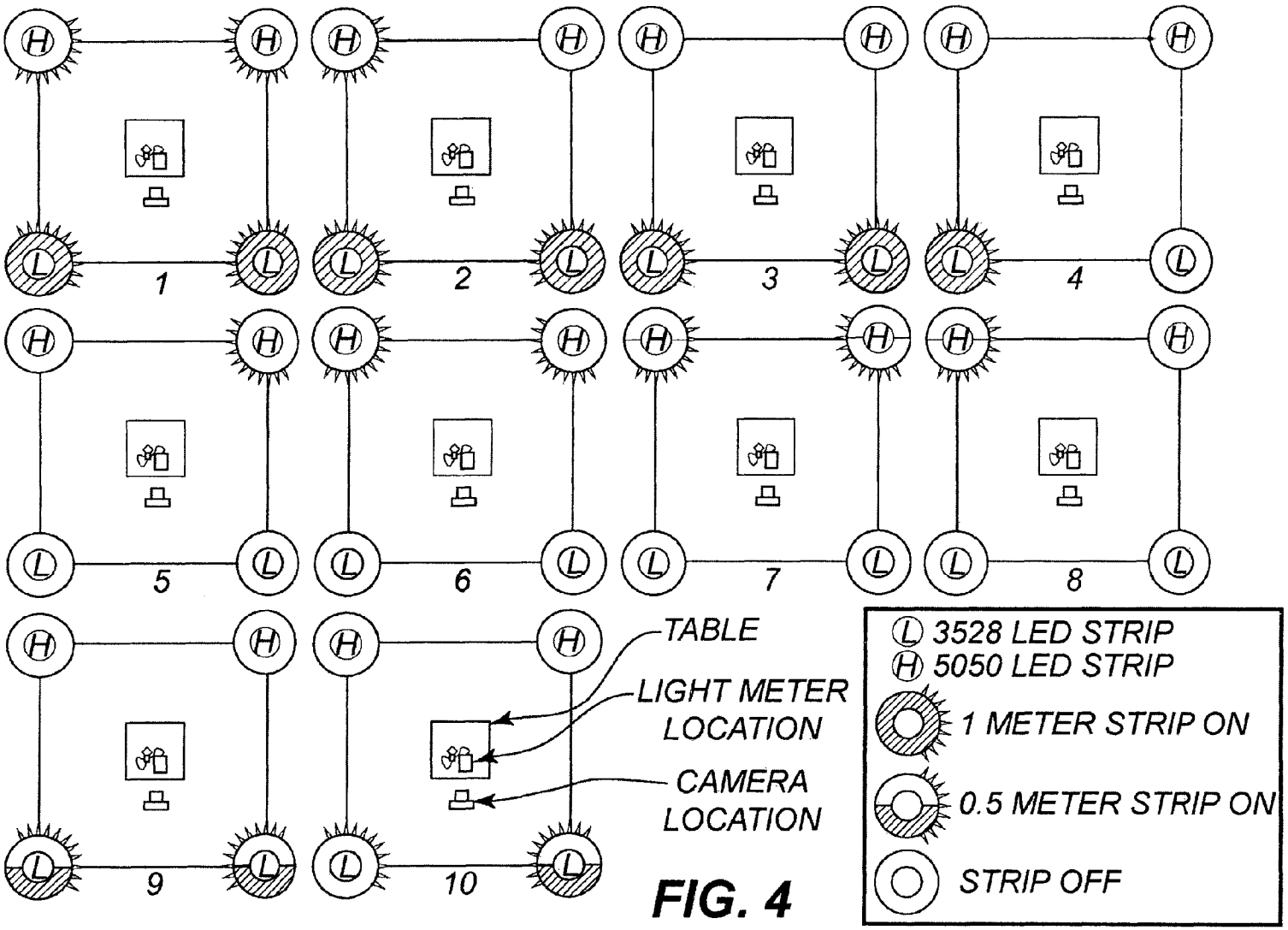
FIG. 4 is a diagrammatic view of placement and use of the device in an outdoor environment with a suitable temporary structure.

FIG. 4 shows a diagrammatic representation of the aforementioned tests. H shows the location of the LED 5050 illumination source. L shows the positioning of the LED 3528 sources. Various combinations of these sources were tried. As a reference, a book was placed on a table in the middle of the 3×3 area and light intensity measured using DSE Q-1400 digital Lux metre. In addition, photographs were taken with a camera setting small f5.6 for 1000 ms at ISO 100. Tests were conducted outdoors on a moonless night to ensure minimum ambient interference or reflective light. The illumination sources were powered with a 12v DC transformer. Results were as follows:

1) 14 Lux—illumination very easy to read
2) 11 Lux—easy to read
3) 9 Lux—readable with little effort
4) 4 Lux—visible but difficult to read
5) 6 Lux—readable with effort
6) 9 Lux—readable with little effort
7) 5 Lux—readable with little effort
8) 2 Lux—very difficult to see detail
9) 5 Lux—readable with little effort
10) 3 Lux—very difficult to see detail.

These results show a number of significant advantages arising from use of the present invention. Firstly, the variability and acceptability of illumination is completely within the control of the user. Power consumption and efficiency is a priority at remote locations. By providing an infinitely variable illumination system a user can simply choose the minimum illumination required for the desired task. Reading a book for instance would be more difficult than laying out a sleeping bag. Accordingly, while further tests are to be conducted it is possible that illumination via the standard brightness LED3528 may be more acceptable in some circumstances than the LED 5050.

It can be seen that the infinite variation and flexibility of the present inventive illumination system can simply not be provided by conventional systems. With the inventive device no wiring is provided in the area illuminated and all illumination is controlled either by individual battery packs or, if desired, a single power source. The safety elements alone provide excellent advantages over conventional systems.

Figure 2A:
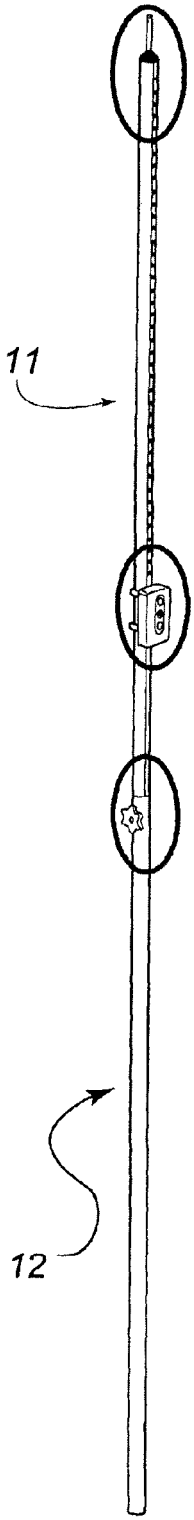
FIGS. 2A-2I show details of a second embodiment of the present invention.
Figure 2B:
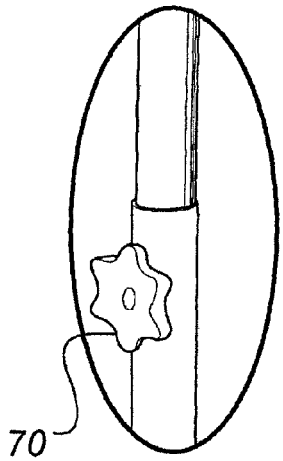

FIG. 2A is a second embodiment of the present invention, and like FIG. 1A, is a view of the device in its extended "in use" configuration. FIGS. 2B, 2C, 2D and 2E are detailed views of various components of the device shown in FIG. 2A. FIGS. 2F, 2G, 2H and 2I are exploded and cross-sectional views of the components of the embodiments shown in FIG. 2A.

Figure 2C:
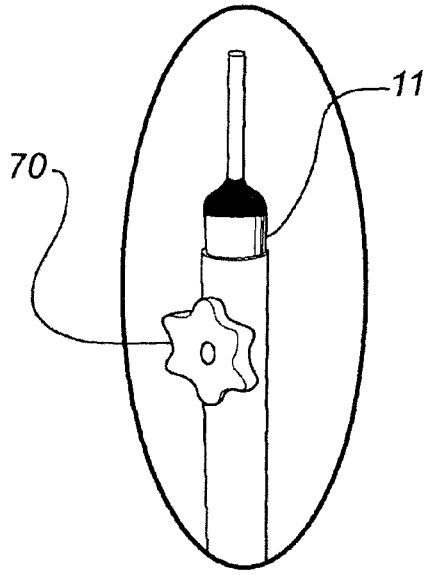
Figure 2D:
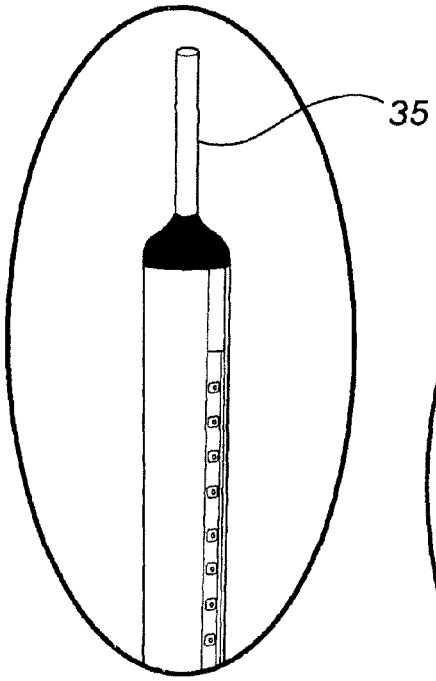
Figure 2E:
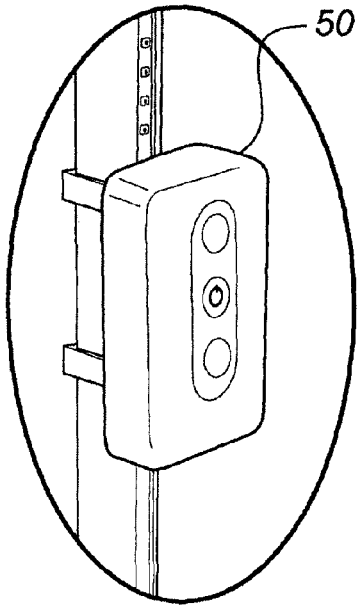
Figure 2F:
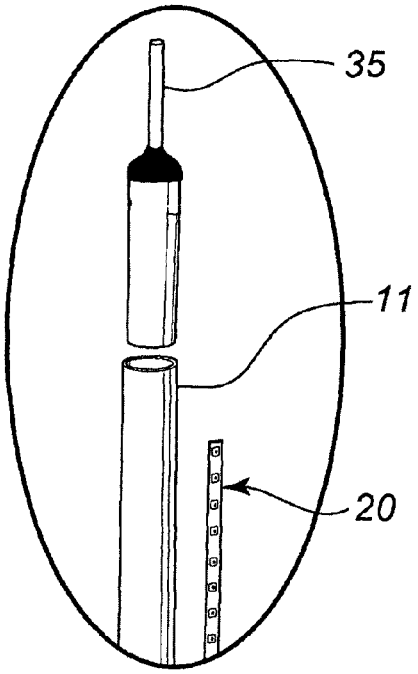
Figure 2G:
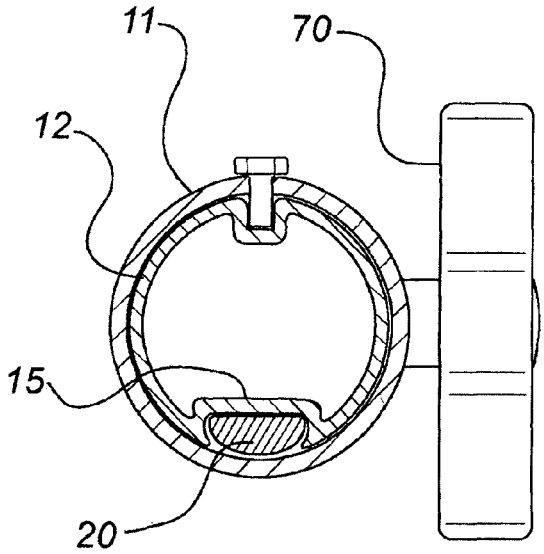
Figure 2H:
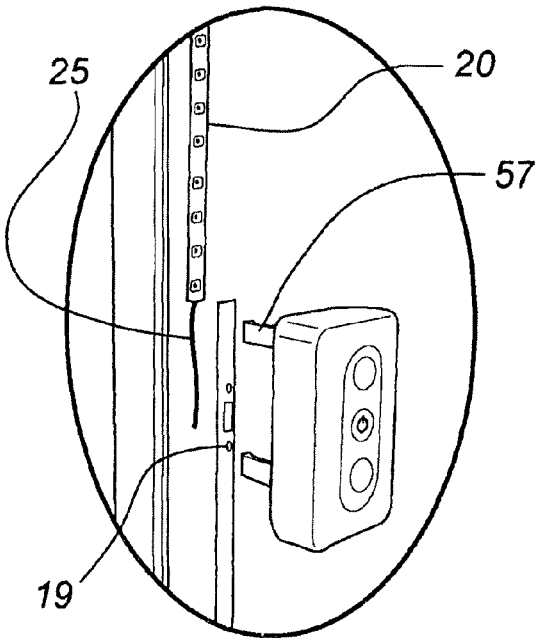
Figure 2I:
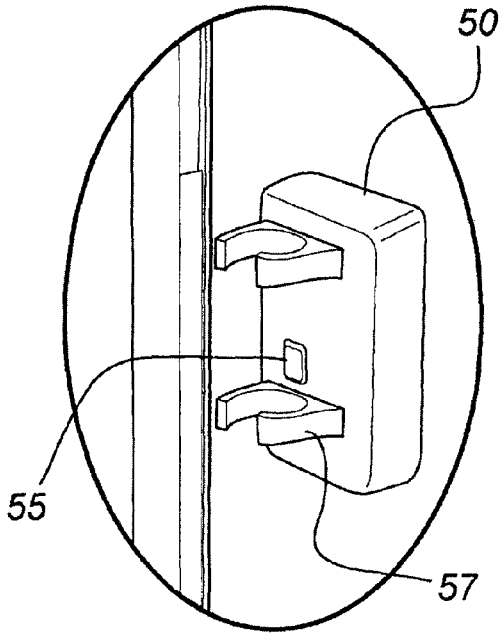

Turning now to the embodiments shown in FIGS. 2A-2I, in this embodiment the bottom portion 12 is larger than the upper portion 11 and is adapted to receive and contain the upper portion 11 as shown in FIG. 2C. This provides an additional advantage of concealing and protecting the illumination source 20 when not in use. In this embodiment the collars shown in FIGS. 1A-1H are not required. Instead the pin or spike 35 for engaging a tent is attached directly into the upper portion 11 of the support element or pole 10. Power control unit 50 can be provided with clips 57 for attachment, with power reaching the illumination source 20 by means of electrical contacts 55 engaging with apertures 19 in the elongated support element 10. (See FIGS. 2H and 2I)

As discussed earlier, a releasable screw lock 70 can be provided on the elongated support element 10 to allow relative movement between the upper and lower portions 11/12 of the elongated support element 10. The power control unit 50 is much the same as the embodiment or FIGS. 1A-1H and can control strip initiation i.e. on/off and brightness levels.

In this embodiment it can be seen that the channel 15 (see FIG. 2G) is recessed into upper portion 11 for integration of the LED strip 20 therein. This ensures the LED does not extend past the perimeter or circumference of the upper portion 11. In turn this allows the upper portion 11 to be wholly contained in the lower portion 12, as discussed above. In addition, with the illumination source 20 not protruding past the circumference or perimeter of the upper portion 11, any passage, sleeve or the like through which the upper portion 11 must pass will not be affected by integration of the illumination source 20. As will be clear to person skilled in the art, some structures require a tent pole or similar elongated support element to pass though a sleeve or similar. By maintaining consistent circumference all the way around the top portion 11 of the elongated support element 10, this portion can be passed through such a passage or sleeve. In this regard, domed tents in particular have such sleeves and it is envisaged that the present invention could similarly be applied to resiliently flexible elongated support elements such as fibreglass or hollow aluminium segmented tent poles.

It is also possible that the energy source 20 can be heat source. As will be clear to a person skilled in the art in much of the same way that the LED strip 20 is integrated into the elongated support element 10, similarly a heat energy source could be integrated to provide a heating device.

In the embodiment of FIG. 2A-2I, as discussed earlier, the upper portion 11 of the elongated support element can have limited rotational movement to direct the illumination emanating from the illumination/energy source 20. Again, this is a significant advantage as compared with the prior art. In the prior art most of the supports are rigid and accordingly the position of the lighting cannot be changed. In the present invention the ability to produce relative movement between different segments of the support element allows positional and directional changes in the illumination or heat emanating from the illumination/heat source integrated into the support element.

FIGS. 3A-3D provides yet a further embodiment. The control unit 50 is similar to that of FIGS. 2A-2I in that is held to the elongated support element 10 by means of clips of clips 57.

In this embodiment two LED strips are integrated into the elongate support element as the illumination source. In this regard the LED strips are held in a wider channel or alternatively two smaller abutting channels 15A and 15B. Once again the illumination source do not extend past the perimeter or circumference of the upper portion 11. In the embodiments shown a lens 16 is also provided over the LED strips 20. It will be noted in FIG. 3B that the lens 16 similarly does not extend past the perimeter or circumference of the top pole extrusion 11.

In this embodiment the length of LED strips is reduced as compared with FIGS. 1A-1H and 2A-2I. It is shown as two half metre length of LED strips rather than the one metre length shown in FIGS. 1A-1H and 2A-2I. This can have a significant advantage in terms of illumination power.

To explain, one advantage of this configuration is that the light emitting section of the unit is located in a small area so there is less effective area to create glare but at the same time, the same amount of light is generated. In addition it is possible to switch between no illumination, one LED strip illumination and illumination with both LED strips, if bright lighting is required. This clearly allows additional flexibility in terms of illumination and conservation of battery power. Further, it is also possible to include one energy strip for lighting and one energy strip for heating. This may require some shielding to ensure no heat damage to the illumination source or spacing of the heat source from the light source but both may be integrated into an elongated support element in accordance with the present invention.

The embodiments shown in FIGS. 3A-3D also further increase the possibility of greater height adjustment since, as shown in FIG. 3, the control unit may be positioned further up the top portion 11 of the elongate support element 10.

In the embodiments shown, the elongated support element 10 and illumination source 20 are provided in a vertical position. It will, however, be clear to persons skilled in the art that such an arrangement of integration of the illumination source 20 into the support element 10 can also be other angles. For instance in a "scissor action" collapsible awning, similar integration of the illumination source may be provided.

Figure 3A:
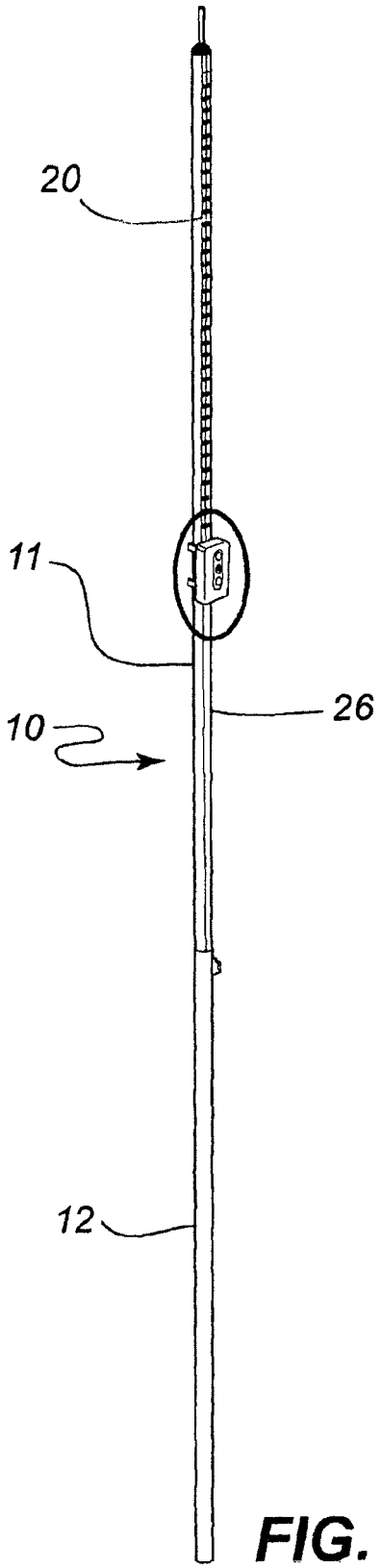
FIGS. 3A-3D show details of a third embodiment of the present invention.
Figure 3B:
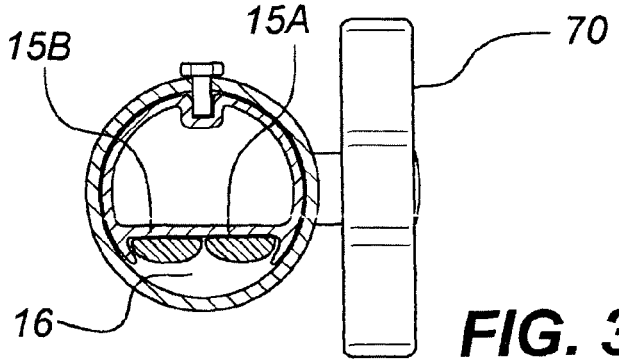
Figure 3C:
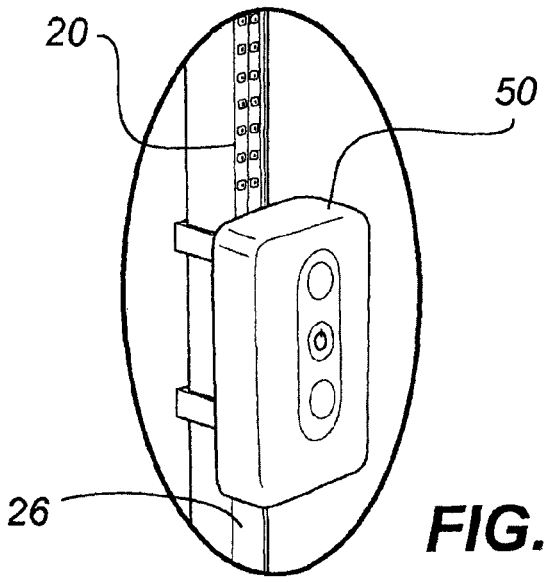
Figure 3D:
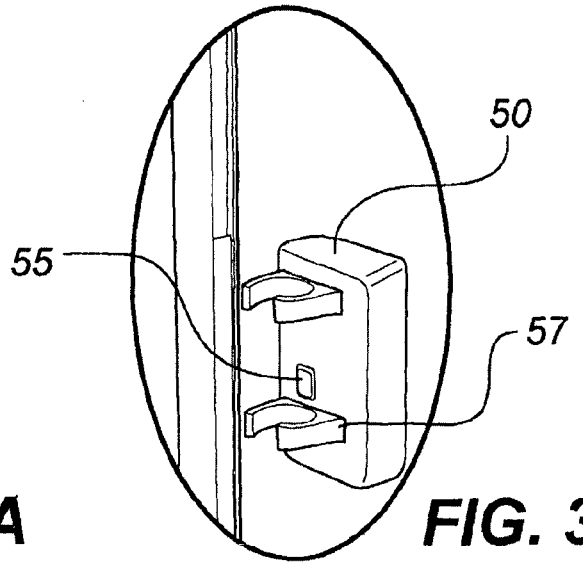

As shown in FIG. 3B, lens 16 covering the LED strips, provides additional protection but also flexibility in terms of the illuminated area. The lens 16 can provide a wider angle of illumination or a narrower range if decided.

In some embodiments, the device may include both types of lens or multiple devices used to provide both broad general illumination and specific narrow higher intensity illumination for particular purposes e.g. talking, reading etc. In yet a further embodiment the lens may be provided by way of rotatable sleeve such that it can be rotate relative to the illumination source 25.

It may also be possible to place the power unit 50 at the top of the elongated support element 10 thereby permitting greater movement of the top portion 11 relative to the bottom portion 12. In another embodiment, the power source may provide power to plurality of illumination sources 20 on separate support elements. This would be particularly the case in a collapsible "scissor action" awing type arrangement or umbrella. Several LED units may be integrated into the arms or awning or umbrella which, once erected, may simply be connected to a power source which can selectively initiate illumination from one or more of the illumination sources and/or alter individual brightness levels of such LED sources.

In addition, the LED can be provided to strobe, flash or provide different colour as an aesthetic effect.

In some embodiments it may be possible to provide wireless power transmission to the illumination sources although it would need to be determined whether this could be done efficiently.

It will be clear to person skilled in the art that there are a wide range of expandable or collapsible structures which use elongated support elements. These structures can be additions to fixed structures e.g. an awning extending from a structural wall or vehicle, or in turn can be a structure in themselves similar to a tent. The present invention provides a device which simultaneously supports at least part of the structure or another element e.g. sign, umbrella, person, and provides illumination.

Figures 5A, 5B, 5C:
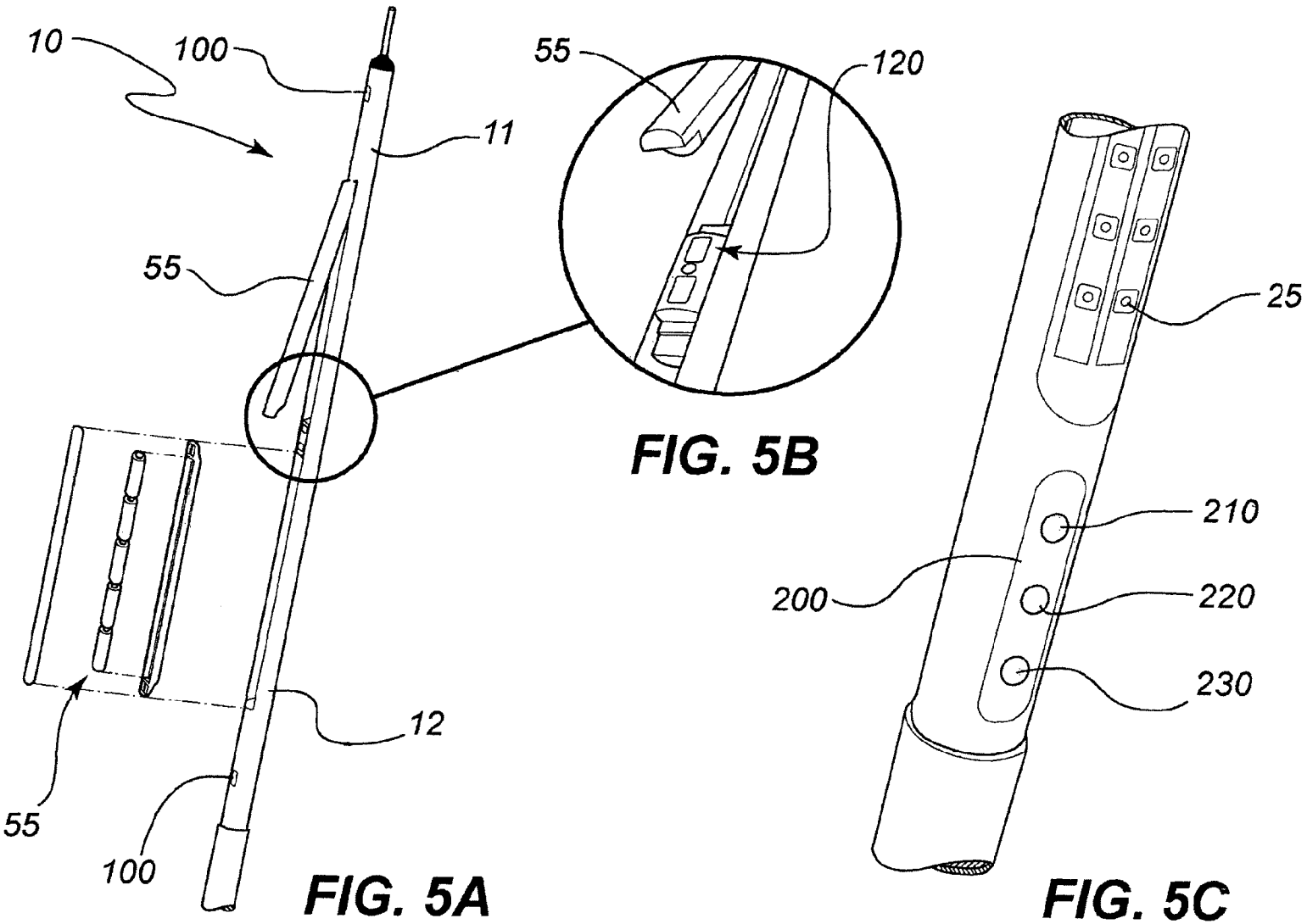
FIGS. 5A-5C show details of a fourth embodiment of the present invention, FIGS. 6A/B, 7A/B and 8A/B are perspective and cross sectional views respectively of three additional embodiments of the present invention.

A further embodiment of the present invention shown in FIGS. 5A-5C. The exploded version is shown in FIG. 5A. The elongated support element 10, again comprises a top portion 11 and bottom portion 12 adapted to telescope together. In this embodiment, however, the top portion 11 has a power source 50 in the form of a battery pack held within the top portion. A cover 55 holds the battery pack in place and protects it from damage. The battery pack 50 can be removed for recharging or alternatively can be recharged in situ via power socket 100 or other mechanism e.g. solar, mechanical wind up etc. These power sockets may also serve to provide external power source for the LED strip 20. In another embodiment, the battery pack may incorporate replaceable batteries. As shown in FIG. 5B, a quick release 120 holds the battery pack securely in place.

FIG. 5C shows more clearly the positioning of the illumination source 20 in the form of LED strips and control mechanism 200. In this instance the control mechanism is a membrane touch sensor. It comprises a simple on/off switch 210, a switch 220 which serves to provide single or dual LED strip illumination and a high/low power button 230. It will be noted that such a membrane touch sensor does not protrude past the width or diameter of the top portion 11 such that it can be telescoped into an entirely sheathed by the lower portion 12. Similar comments apply to the LED strips 20 as discussed above.

Figure 6A:
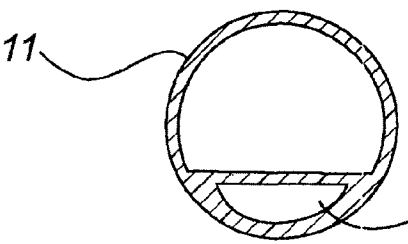
Figure 6B:
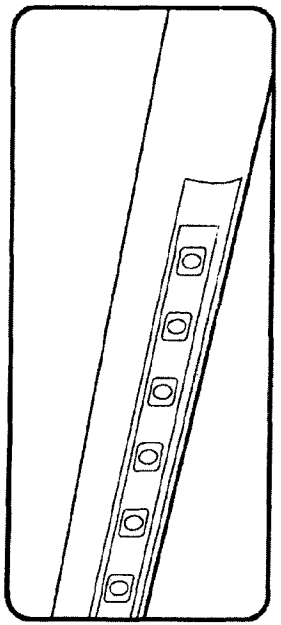

Turning now to the embodiments shown in FIGS. 6A/B, 7A/B, and 8A/B, these embodiments show the various configurations of the illumination source or LED strips 25 and how it can be positioned on the elongated support element. In FIGS. 6A and 6B, a single LED strip is provided. This is generally for a small diameter pole 11 with low power and an external battery pack as the interior of the elongated support element may be too small to house a power source.

Figure 7A:
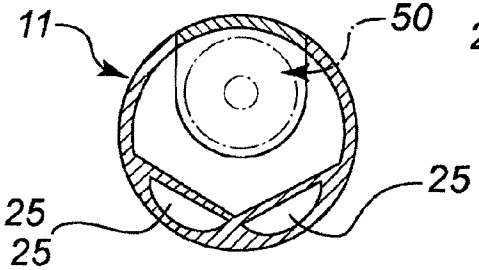
Figure 7B:
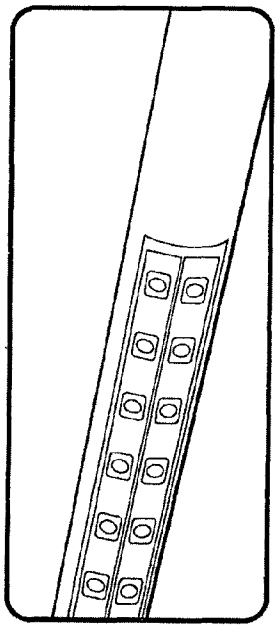

The embodiment shown in FIGS. 7A and 7B can use a single or dual LED strips 25. It will be noted that the portion 11 of the elongated support element is slightly larger than FIGS. 6A/B and can hold power source 50 in the form of an integral battery pack. As mentioned above, external power may also be provided.

Figure 8A:
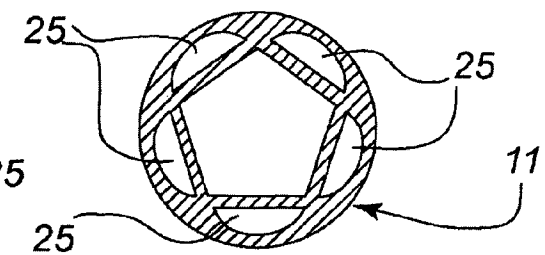
Figure 8B:
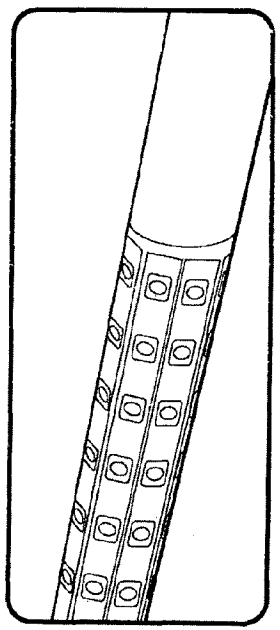

The last version show in FIGS. 8A and 8B include multiple LED strips. In this embodiment there are five LED strips 25 however a skilled addressee will recognise more or less can be provided. It will be noted that the larger the number of LED strips 25 the greater the reduction in interior volume of the elongated support element 11. In this embodiment an external battery pack or external power supply is generally provided depending upon the diameter of the elongated support element.

It will also be noticed that in embodiments shown that the LED strip or illumination source preferably extends across almost the entirety of the one of the segments or portion of the elongated support elements. To explain most telescopic or collapsible elongated support elements are made up of a number of segments. These segments are generally directly adjacent to each other in a collapsed or retracted configuration by nesting of one segment within another (telescopic) or held directly adjacent to each other (collapsible/scissor action). In the extended configuration the segments are generally placed end on end or in extended telescopic fashion. It will be noted in the embodiments shown that the illumination source/LED strip 20 extends for substantially the entire length of one of the segments. In other words, the illumination and power source of the device can be wholly contained in one segment if necessary. Again, this is entirely unlike the conventional systems in which an illumination source may be provided but is generally located in only one position on the support element or the entire length or the element. In one particular embodiment which may be extremely favourable, LED strips can be provided in more than one segment such that, with the available relative movement between the segment, illumination or heat may be provided in different directions. For instance, in tent pole form, the device may be provided at a corner position with an upper portion and a lower portion providing illumination and/or heat at 90 degrees relative to each other. A person skilled in the art will of course be able to determine other configurations in this regard.

Figures 9A, 9B, 9C:
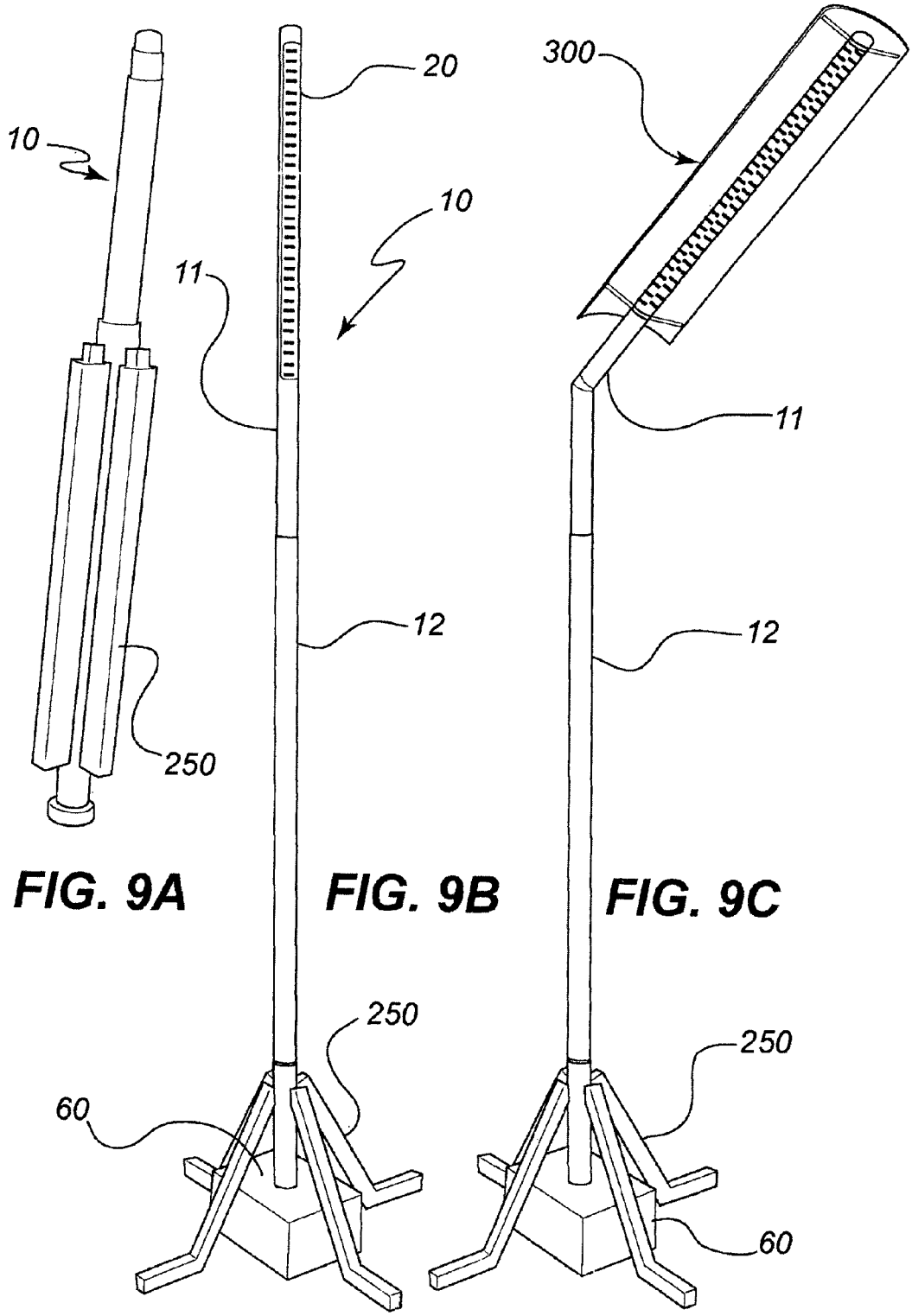
FIGS. 9A-9C shows details of a fifth embodiment of the present invention and FIGS. 10-14 are further and additional embodiments incorporating the device of the present invention, displaying is application its alternative environments.

FIGS. 9A-9C show yet a further embodiment of the present invention as a compact portable lighting unit. The device is shown in its collapsed or retracted configuration in FIG. 9A. FIG. 9B shows the device in one extended configuration. The elongated support element 10 is preferably held in place by optional legs 250. An external power source 60 is provided at the base of the elongated support element 10. This external power source can also stabilise the device.

In the embodiments shown, the upper portion 11 of the device is similar to the embodiments shown in FIGS. 8A-8B namely that it includes a number LED strips as the illumination source 20.

FIG. 9C shows an alternative extended configuration. In this form a reflector 300 can be attached to the upper portion device as adjacent the illumination source 20 to thereby reflect and direct illumination emanating from some of the LED strips. A hinge 350 or similar device can be incorporated in the elongated support element to position the upper portion 11 and thereby direct the illumination as desired.

FIG. 10 displays is a typical example of use of the present inventive device with a tent. As shown several devices 10 may be placed around, the tent to support the structure while simultaneously illuminating the area.

Figure 11:
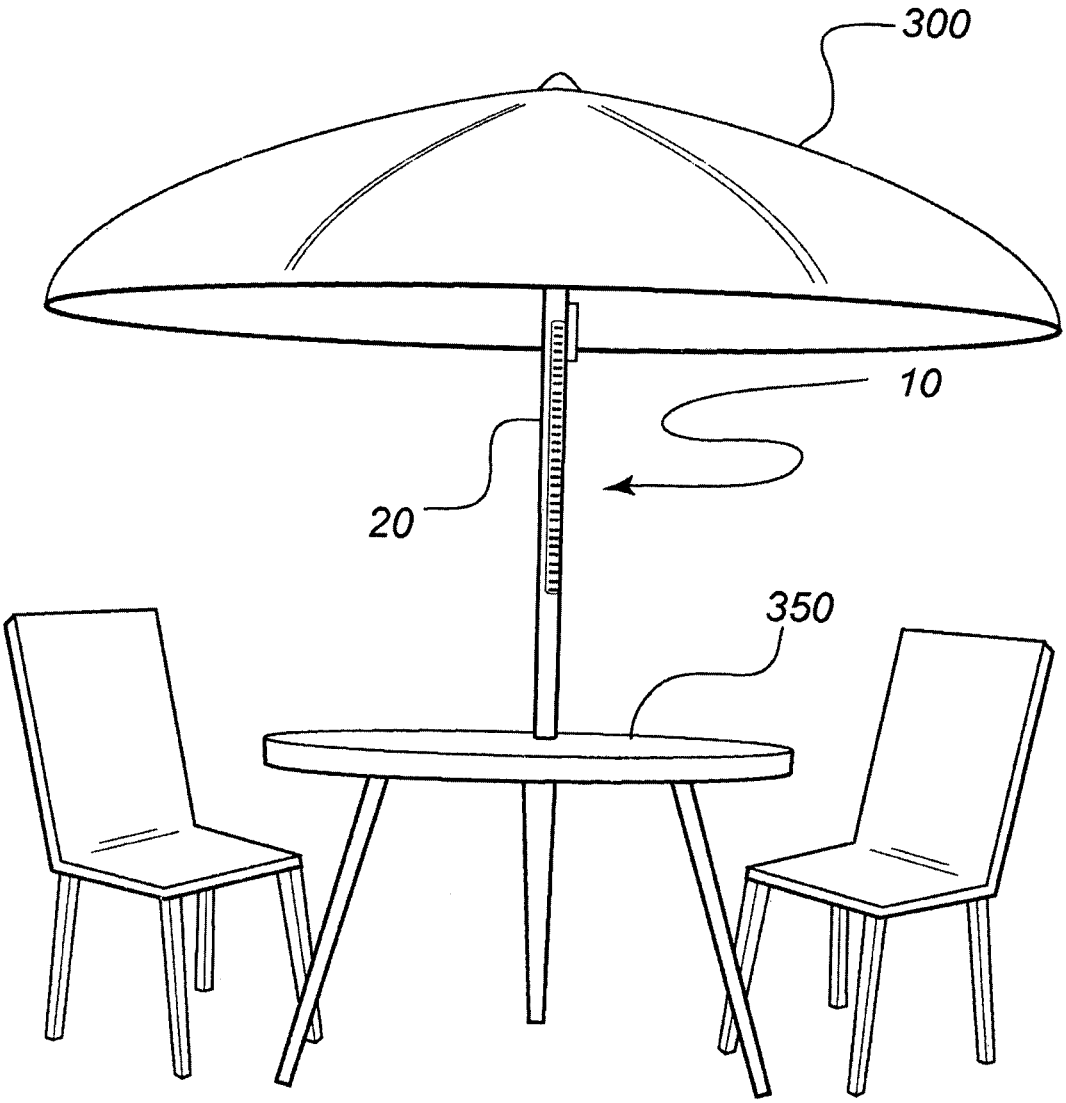

FIG. 11 is an example of use of the present invention in a cafe or outdoor entertainment area. In this embodiment the device 10 is provided as the support element for an umbrella 300. Again, it is preferably that the device 10 comprises segments which are relatively moveable with respect to each other. In this embodiment the illumination source 20 is preferably moveable and more preferably rotatable relative to the table 350 and/or umbrella 300. This permits the illumination to be directed as required for the occupants or the table 350. The umbrella 300 itself may be collapsible however it is envisaged that the device can be used with rigid non-collapsible umbrellas.

Figure 12:
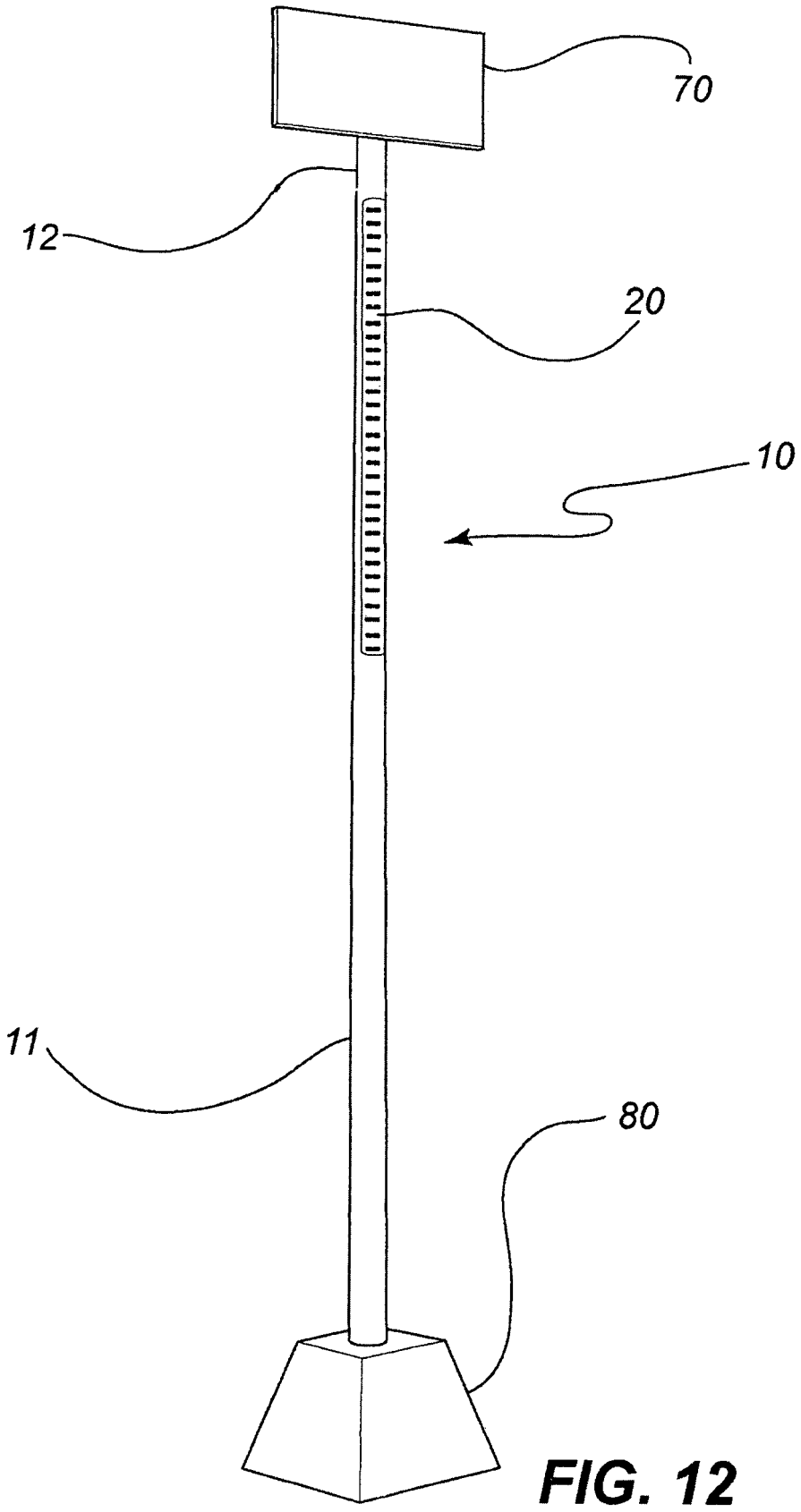

Another embodiment is shown in FIG. 12. In this embodiment the inventive devices 10 provides support and illumination in an emergency rescue environment. The elongated support element 10 once again provides an illumination source 20 with an emergency indicator or sign 70 supported atop the elongated support element 10. In this embodiment a base 80 is provided to hold the elongated support element in its vertical configuration.

Figure 13:
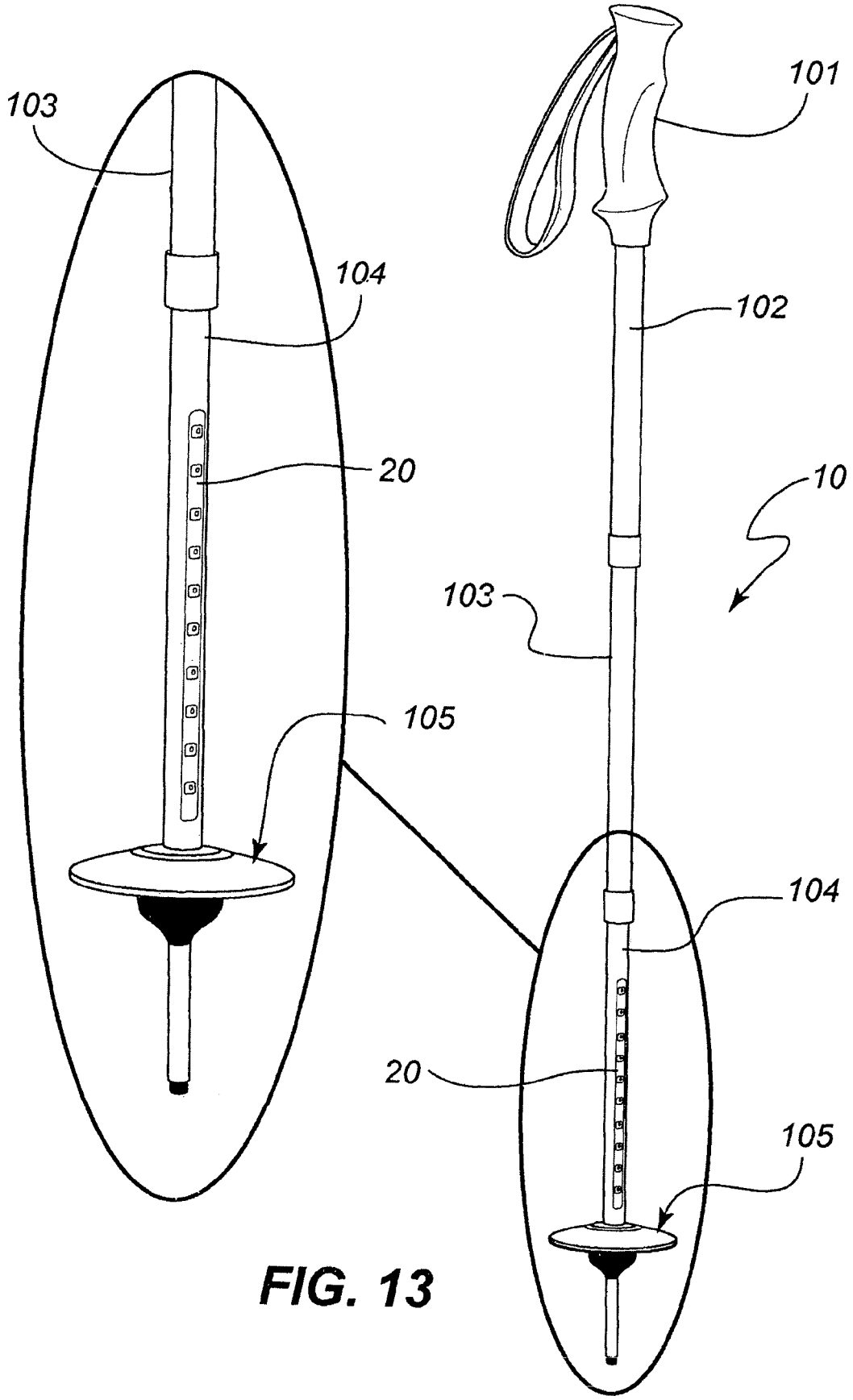

Yet still a further embodiment is shown in FIG. 13. In this embodiment a telescopic hiking or skiing pole is provided. The pole has a handle portion 101 with a foot portion 105. A series of pole segments 102, 103, 104 is provided there between. At least one of these segments is provided with an illumination strip 20 similar in nature to the embodiments shown above. Clearly such a device is extremely flexible in its use. It can of course be used as a hiking or skiing pole for instance providing excellent illumination of the ground or snow. Again, this device provides the dual support and illumination functions.

Figure 14:
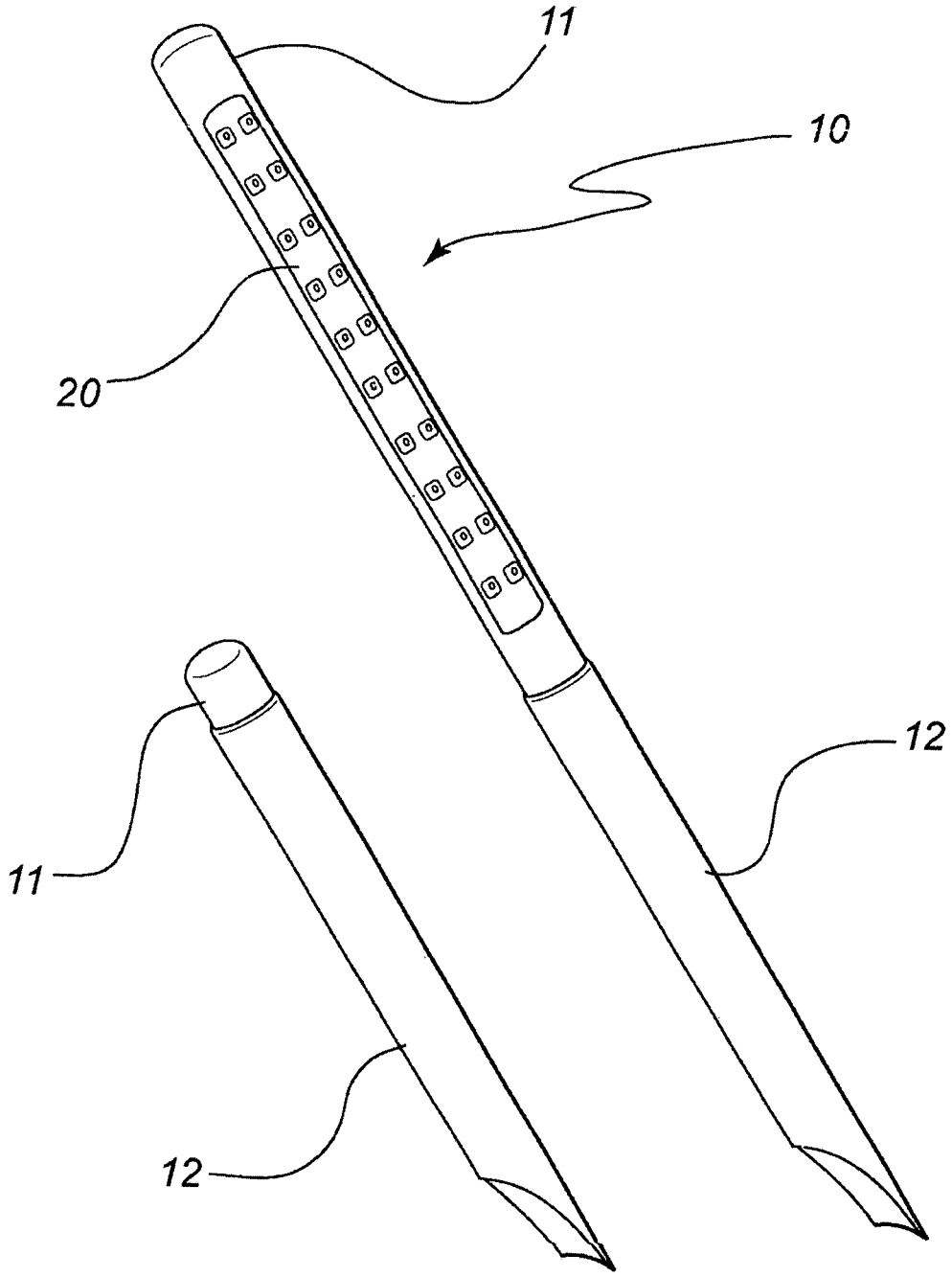

In a further embodiment, shown in FIG. 14 a similar emergency lighting configuration is provided. The device has a lower portion 12 formed as a peg for entry into the ground. In such a configuration the device may then be extended to reveal upper portion 11 and provide lighting as designed. It will be envisaged that normally this device will be placed vertically in the ground, however it could also be placed horizontally to extend from a wall or similar arrangement.

Many other embodiments will be envisaged by person skilled in the art. In some embodiments the illumination device may be provided in a central portion with telescoping arms extending from the central portion to reveal a central the illumination source.

It will be clear to the persons skilled in the art that there are significant advantages associated with the present invention over conventional systems. The elegant, safe and easy illumination provided by the present invention is clear. The flexibility in terms of illumination quantity and power conservation is also not available using conventional systems. The illumination source can be used as a standalone unit as well as part of a temporary/collapsible structure. It will be envisaged in some instances that the elongated support elements can be used simply for their illumination capability rather than illumination with simultaneous structural support. For instance, the present invention allows camping or structures to be set up at night be simply initially setting up and initiating illumination with one or more elongated support elements which, once the structure is sufficiently erect can then be transferred to the dual illumination/support configuration.

In other embodiments as discussed above the device can be used in internal as well as external settings for heating or emergency illumination. It can be used as a portable device such a walking stick or hiking pole.

It will be envisaged that other modification and variations may be made to the device of the present invention without departing from the spirit or scope of the inventive idea.

The invention claimed is:

1. A telescopically extending support pole for a collapsible or temporary structure, the support pole comprising:

a plurality of sections engaged to be telescopically extendable between a retracted configuration and an extended configuration, and one or more of said sections including an integrated illumination source housed within one or more longitudinal extending channels or grooves, the channels or grooves being of a depth such that no part of the illumination source extends beyond the perimeter of the support pole thereby allowing telescopic extension between the sections.

2. A telescopically extending support pole as claimed in claim 1, wherein in said extended configuration, relative rotation between the sections is permitted.

3. A telescopically extending support pole as claimed in claim 1, wherein said illumination source is integrated in one of said sections.

4. A telescopically extending support pole as claimed in claim 3, wherein said illumination source extends for substantially the entire length of said section.

5. A telescopically extending support pole as claimed in claim 1, wherein said illumination source is provided on more than one of said sections such that the relative positioning and direction of said illumination sources may be altered when said device is in the extended configuration.

6. A telescopically extending support pole as claimed in claim 1 further comprising a releasable screw lock configurable to lock said plurality of sections in said retracted or extended configuration or a position in between.

7. A telescopically extending support pole as claimed in claim 1, wherein the illumination source is a plurality of light emitting diodes configured as a longitudinal array.

8. A telescopically extending support pole as claimed in claim 1, wherein said illumination source is provided as an elongated strip.

9. A telescopically extending support pole as claimed in claim 1, wherein said channels or grooves are integrally formed in said one or more sections.

10. A telescopically extending support pole as claimed in claim 1, wherein said longitudinal extending channels or grooves are open.

11. A telescopically extending support pole as claimed in claim 1, wherein each section is formed from an extruded material having a substantially constant cross-section.

12. A telescopically extending support pole as claimed in claim 1, wherein each section is formed from a resilient material.

13. A telescopically extending support pole as claimed in claim 1, wherein each section is of unitary construction.

14. A telescopically extending support pole as claimed in claim 1, wherein said illumination source is provided with power via by a power source adapted to be releasably connected to one of said sections.

15. A telescopically extending support pole as claimed in claim 14, wherein said power source is a rechargeable battery pack.

16. A telescopically extending support pole as claimed in claim 1, wherein the illumination source is powered by solar power.

17. A telescopically extending support pole as claimed in claim 1, wherein a power source for the illumination device is housed within one of the sections.

18. A telescopically extending support pole as claimed in claim 1, wherein the illumination device comprises a connection to receive an external power supply.

19. A tent pole comprising a telescopically extending support pole as claimed in claim 1.

* * * * *